US006268593B1

(12) United States Patent
Sakai

(10) Patent No.: US 6,268,593 B1
(45) Date of Patent: Jul. 31, 2001

(54) COOKING APPARATUS CAPABLE OF DETERMINING WEIGHT OF FOOD ON TURN TABLE AND METHOD OF DETECTING WEIGHT OF FOOD ON TURN TABLE

(75) Inventor: Haruo Sakai, Hikone (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/695,320

(22) Filed: Oct. 25, 2000

(30) Foreign Application Priority Data

Oct. 29, 1999 (JP) ..... 11-309179

(51) Int. Cl.[7] ..... H05B 6/68; H05B 6/78

(52) U.S. Cl. ..... 219/518; 219/708; 219/720; 219/754; 99/325; 177/84; 177/48

(58) Field of Search ..... 219/518, 708, 219/754, 755, 762, 720; 99/325, DIG. 14, 451; 177/83, 48, 84, 41, 42, 54

(56) References Cited

U.S. PATENT DOCUMENTS 4,489,800 * 12/1984 Nufer et al. ..... 177/212
4,595,827 * 6/1986 Hirai et al. ..... 219/518
4,673,800 * 6/1987 Hirai et al. ..... 219/708

FOREIGN PATENT DOCUMENTS 5-10527 * 4/1984 (JP) .
59-63426 * 4/1984 (JP) .

* cited by examiner

*Primary Examiner*—Philip H. Leung
(74) *Attorney, Agent, or Firm*—Armstrong, Westerman, Hattori, McLeland & Naughton, LLP

(57) ABSTRACT

In a microwave oven, a turn table rotates once in a period TX. During one rotation of turn table, a control circuit usually detects six pulse signals. Control circuit detects a weight of food placed on turn table based on detected intervals TA, TB, and TC of pulse signals. Note that, if six pulse signals are not detected during one rotation of turn table, the control circuit retries detection of the pulse signals and detects the weight of food placed on turn table based on TA, TB, and TC for a subsequent rotation of turn table.

13 Claims, 15 Drawing Sheets

COOKING APPARATUS CAPABLE OF DETERMINING WEIGHT OF FOOD ON TURN TABLE AND METHOD OF DETECTING WEIGHT OF FOOD ON TURN TABLE

BACKGROUND OF THE INVENTION

1. Field of the Invention

The present invention relates to cooking apparatuses and, more particularly, to a cooking apparatus capable of determining a weight of food to be heated.

2. Description of the Background Art

A conventional cooking apparatus may include a weight sensor for detecting a weight of food in a heat chamber. Such a cooking apparatus automatically determines a heating time or the like based on the detected weight of food for cooking.

Examples of such a weight sensor include a device outputting a pulse signal at a different timing according to the weight of food. The weight sensor detects the pulse signal output from the above mentioned device and determines the weight of food based on the timing at which the pulse signal is detected. The cooking apparatus uses the determined weight of food for automatic cooking.

However, the weight sensor suffers from a problem that the pulse signal may not be properly detected due to an external noise or the like. In such a case, the detected weight of food considerably deviates from the actual weight, so that a user does not satisfy with the automatic cooking performed by the cooking apparatus.

SUMMARY OF THE INVENTION

The present invention is made to solve the aforementioned problem. An object of the present invention is to provide a cooking apparatus provided with a weight sensor capable of accurately detecting a weight of food.

According to one aspect of the present invention, the cooking apparatus includes: a turn table on which food is to be placed for periodic rotation; a weight indicating portion; a signal outputting portion; and a weight determining portion. The weight indicating portion has a magnet, varies a magnetic field intensity in a prescribed position with a prescribed frequency (number of times) in a rotation period of the turn table, and changes a timing at which the magnetic field intensity varies in the prescribed position in the rotation period of the turn table according to the weight of food placed on the turn table. The signal outputting portion outputs a pulse signal differently according to the variation in the magnetic field intensity in the prescribed position. The weight determining portion receives the signal output from the signal outputting portion for determining the weight of food according to a timing of receiving the pulse signal in the rotation period of the turn table. Note that the weight determining portion determines the weight of food only when the pulse signals are received with the prescribed frequency in the rotation period of the turn table.

According to the present invention, the weight determining portion determines the weight of food only when the pulse signals are properly received. In other words, if the weight determining portion does not receive the pulse signals with the prescribed frequency during one rotation of the turn table, the pulse signals received by the weight determining portion in that rotation of the turn table are ignored in detecting the weight of food. Then, the weight of food is detected based on the pulse signals subsequently received by the weight determining portion.

Thus, even if the pulse signals to be used for the determination of the weight of food are not properly transmitted/received or a pulse signal affected by an external noise is present under certain circumstances, the pulse signal that is considered to have been adversely affected would not be used for the detection of the weight of food. Thus, the weight of food can be detected more accurately in the cooking apparatus.

In the cooking apparatus of the present invention, preferably, if a frequency of receiving the pulse signals output from the signal outputting portion in the rotation period of the turn table is less than the prescribed frequency, the weight determining portion determines the weight of food according to the timing of receiving the pulse signals in a subsequent rotation period of the turn table.

The cooking apparatus of the present invention further includes a heating portion heating food to be heated, and a heat controlling portion controlling a heating operation of the heating portion. The heat controlling portion preferably ends the heating operation of the heating portion in the event that the weight determining portion fails to receive the pulse signals output from the signal outputting portion during one rotation of the turn table with the prescribed frequency after such event successively occurs with a given frequency.

Thus, the cooking apparatus would not continue to heat when it is in some kind of trouble.

Preferably, the cooking apparatus of the present invention includes a notifying portion. The notifying portion notifies the event that the weight determining portion fails to receive the pulse signals output from the signal outputting portion during one rotation of the turn table with the prescribed frequency after such event successively occurs with the given frequency.

Thus, a user can easily realize that the weight determining portion cannot determine the weight of food properly.

The cooking apparatus of the present invention preferably includes a notifying portion. The notifying portion notifies that the weight determining portion cannot properly determine the weight of food if the weight determining portion has never received the pulse signal from the signal outputting portion in a prescribed time period.

The cooking apparatus of the present invention preferably includes a sound generating portion and a sound setting portion. Note that the sound generating portion can generate a plurality of different sound patterns which have been preliminary set and generates a sound if a prescribed condition is met. The sound setting portion sets the sound pattern to be generated by the sound generating portion among the plurality of sound patterns. It is noted that the sound generating portion generates a sound according to the set sound pattern when the sound pattern is set by the sound setting portion.

The cooking apparatus according to another aspect of the present invention includes: a turn table on which food is to be placed for periodic rotation; a weight indicating portion; a signal outputting portion; and a weight determining portion. The weight indicating portion has a magnet, varies a magnetic field intensity in a prescribed position with a prescribed frequency in a rotation period of the turn table, and changes a timing at which the magnetic field intensity in the prescribed position changes in the rotation period of the turn table according to the weight of food placed on the turn table. The signal outputting portion differently outputs pulse signals according to the variation in the magnetic field intensity in the prescribed position. The weight determining portion receives a signal output from the signal outputting portion for determining the weight of food according to the timing of receiving the pulse signal in the rotation period of the turn table. If the weight determining portion receives two different pulse signals at an interval shorter than a prescribed interval, it invalidates the second one of the received two pulse signals.

According to the present invention, if the weight determining portion receives a pulse signal at an unusual timing with respect to reception of a pulse signal which has been received immediately before, that unusually received pulse signal is determined an external noise and ignored in detecting the weight of food.

Thus, if the pulse signals used for the determination of the weight of food are not transmitted/received properly under certain circumstances, the pulse signal which is considered to have been adversely affected by abnormal transmission/reception would not be used in detecting the weight of food. Accordingly, the cooking apparatus can detect the weight of food more accurately.

A method of detecting a weight of food on a turn table according to still another aspect of the present invention refers to a method of detecting a weight of food placed on a turn table of a cooking apparatus including a turn table for periodic rotation, and a weight indicating portion varying a magnetic field intensity in a prescribed position with a prescribed frequency in a rotation period of the turn table. It is noted that the timing at which the weight indicating portion varies the magnetic field intensity in the prescribed position changes according to the weight of food placed on the turn table. The method includes steps of: outputting a pulse signal differently according to the variation in the magnetic field intensity in the prescribed position; and receiving the pulse signal for determining the weight of food according to the timing of receiving the pulse signal only when a frequency of receiving the pulse signals in the rotation period of the turn table equals to the prescribed frequency.

According to the present invention, the weight of food is determined only when the pulse signals are properly received. In other words, if the pulse signals are not received with a prescribed frequency during one rotation of the turn table due to an external noise or the like, the pulse signals received by the weight determining portion in that rotation of the turn table are ignored in determining the weight of food. The weight of food is detected based on pulse signals subsequently received by the weight determining portion.

Accordingly, even if the pulse signals to be used for the determination of the weight of food are not transmitted/received properly or a pulse signal affected by the external noise is present, the pulse signal which is considered to have been adversely affected would not be used for the detection of the weight of food. As a result, the weight of food on the turn table can be detected more accurately.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Now, an embodiment of the present invention will be described with reference to the drawings.

Figure 1A:
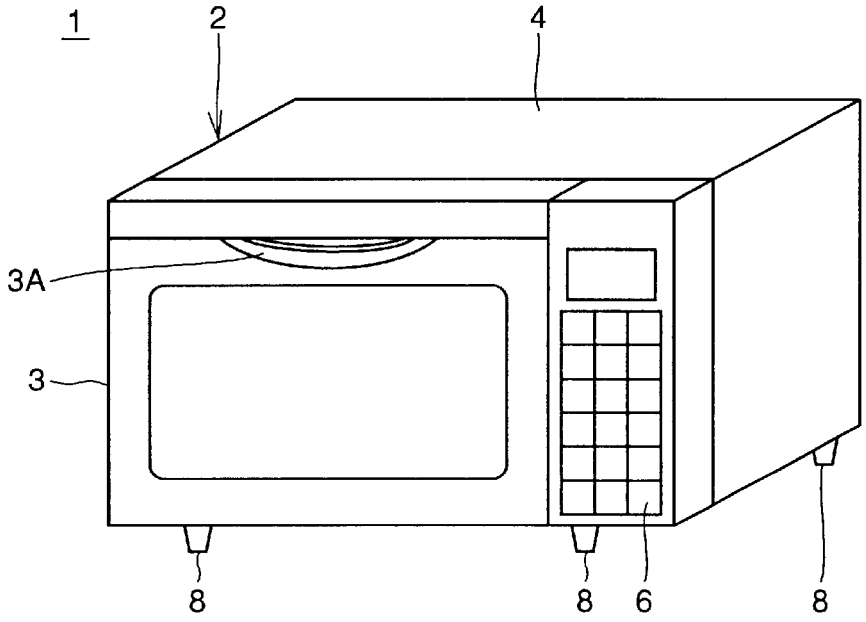
FIG. 1A is a perspective illustration of a microwave oven according to a first embodiment of a cooking apparatus of the present invention.

Referring to FIG. 1A, a microwave oven 1 mainly includes a body 2 and a door 3. Body 2 has an exterior 4 enclosing body 2, a control panel 6, and a plurality of legs 8. Note that control panel 6 is provided on a front face of microwave oven 1 for enabling a user to operate microwave oven 1. Door 3 has a handle 3A for opening/closing door 3.

Figure 1B:
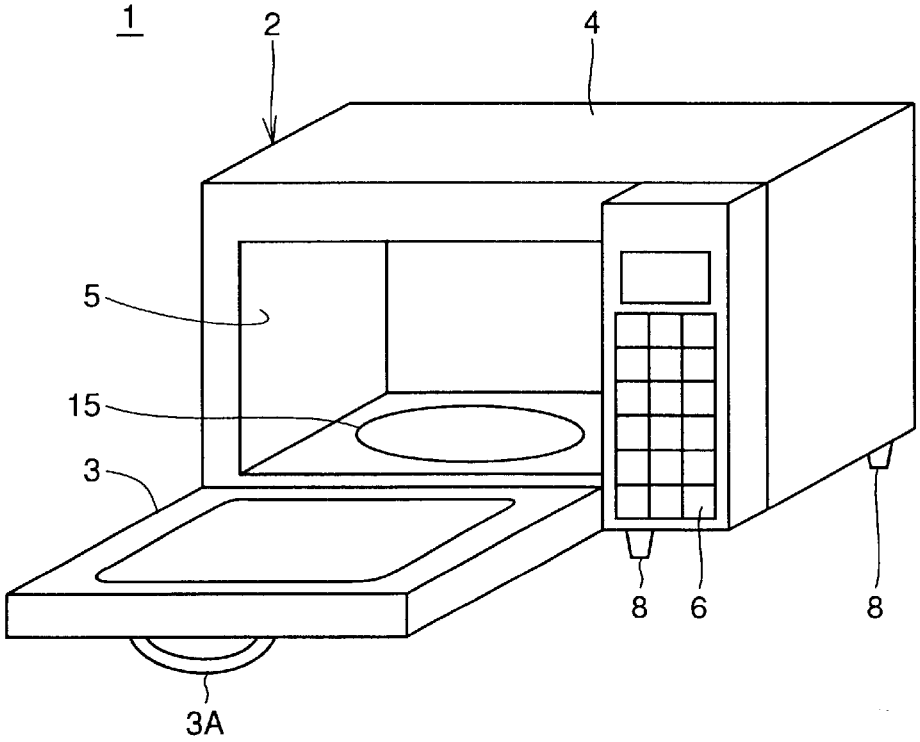
FIG. 1B is an illustration of the microwave oven of FIG. 1A with its door opened.

Referring to FIG. 1B, a heat chamber 5 is arranged behind door 3 and inside body 2. A turn table 15 for placing food is arranged in heat chamber 5.

Figure 2:
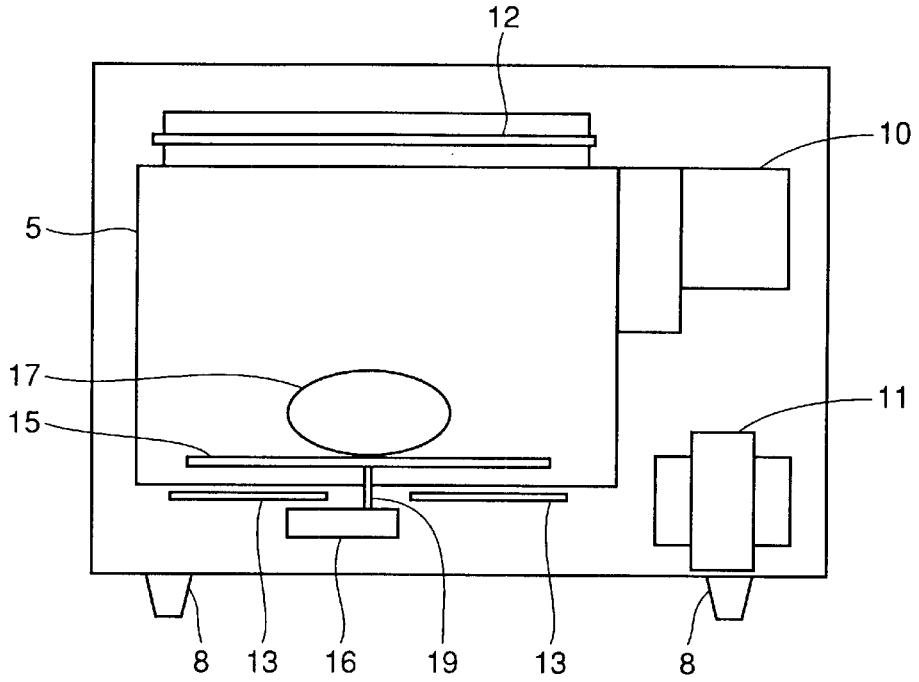
FIG. 2 is a diagram schematically showing an internal structure of a body of the microwave oven shown in FIG. 1A.

Referring to FIG. 2, heat chamber 5 is provided with an upper heater 12 and a lower heater 13 for heating heat chamber 5. Food 17 is placed on turn table 15. Provided on the right side of heat chamber 5 are a magnetron 10 and a transformer 11 for supplying magnetron 10 with electric power. Magnetron 10 oscillates a radio wave at a high frequency for cooking food 17. Positioned below heat chamber 5 is a turn table control box 16 (hereinafter simply referred to as a control box 16) for rotationally driving turn table 15. Turn table 15 and control box 16 are connected by a shaft 19. Control box 16 internally includes a mechanism for rotating shaft 19. Rotation of shaft 19 allows turn table 15 to rotate.

Positioned behind magnetron 10 is a fan (not shown) for cooling heated magnetron 10. Provided on the left side of heat chamber 5 is a heat chamber light (not shown) for illuminating heat chamber 5 with light while magnetron 10 or upper heater 12 and lower heater 13 heat for cooking.

In microwave oven 1, the weight of food 17 on turn table 15 can be detected. Microwave oven 1 provides for automatic cooking in accordance with the detected weight of food 17. Note that a member in control box 16 is used for detecting the weight of food. In the following, the internal structure of control box 16 will be described in conjunction with detection of the weight of food 17.

Figure 3:
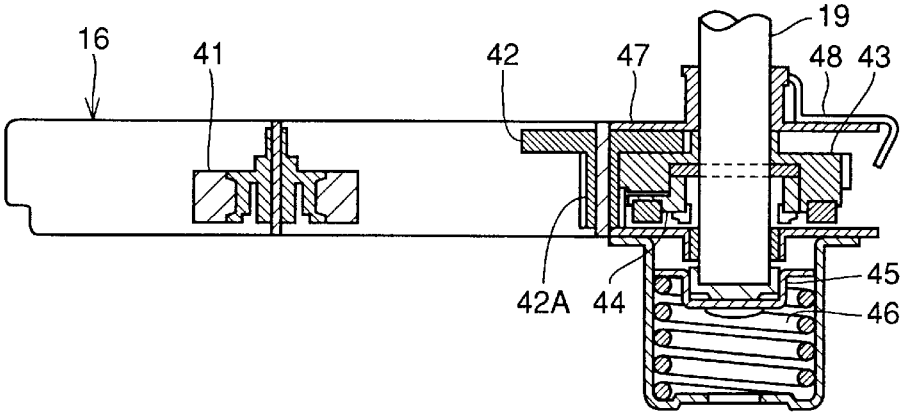
FIG. 3 is a longitudinal cross sectional view of a turn table control box shown in FIG. 2.

Referring to FIG. 3, a lower end of shaft 19 is inserted into control box 16. The lower end of shaft 19 has a bearing 45. Further, a spring 46 is provided below bearing 45. Shaft 19 is downwardly energized by spring 46 through bearing 45.

An upper presser 47 is arranged on the upper surface of control box 16 to surround shaft 19. A spring 48 is positioned on upper presser 47.

A stationary magnet holder 43 and a movable magnet holder 44 are fitted onto shaft 19 between upper presser 47 and bearing 45. Stationary magnet holder 43 is generally fitted onto shaft 19 to be positioned outside movable magnet holder 44. Upper presser 47 is arranged to have contact with an upper end of stationary magnet holder 43. Stationary magnet holder 43 and movable magnet holder 44 are downwardly energized by spring 48 through upper presser 47.

Stationary magnet holder 43 has teeth at its periphery so that it acts as a gear. Shaft 19 has a horizontally protruding pin (a pin 19*a* which will later be described), which is inserted into stationary magnet holder 43 and movable magnet holder 44 at a prescribed location. Thus, as stationary magnet holder 43 and movable magnet holder 44 horizontally rotate, shaft 19 rotates accordingly. Further, as shaft 19 horizontally rotates, turn table 15 rotates accordingly. Therefore, horizontal rotation of stationary magnet holder 43 and movable magnet holder 44 causes turn table 15 to rotate accordingly.

A turn table motor 41 is provided in control box 16 apart from shaft 19. Further, a gear 42 is provided in control box 16, which rotates by rotation of turn table motor 41. Note that gear 42 has a vertically extending shaft portion 42A, which has teeth at its periphery. The teeth at the periphery of shaft portion 42A mate with those of stationary magnet holder 43. Consequently, as turn table motor 41 rotates, turn table 15 rotates along with gear 42, stationary magnet holder 43, and shaft 19.

Note that turn table motor 41 is an AC (Alternating Current) synchronous motor. Thus, turn table 15 rotates with a period dependent on a frequency of a power supply source. For example, if the frequency of the power supply source (an AC power supply source 100 which will later be described) is 60 Hz and 50 Hz, turn table 15 rotates with periods of 10 seconds and 12 seconds, respectively.

Figure 4A:
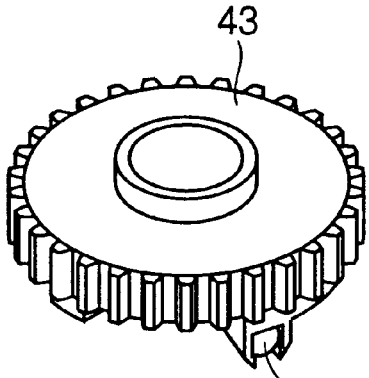
FIG. 4A is a perspective view of a stationary magnet holder shown in FIG. 3.
Figure 4B:
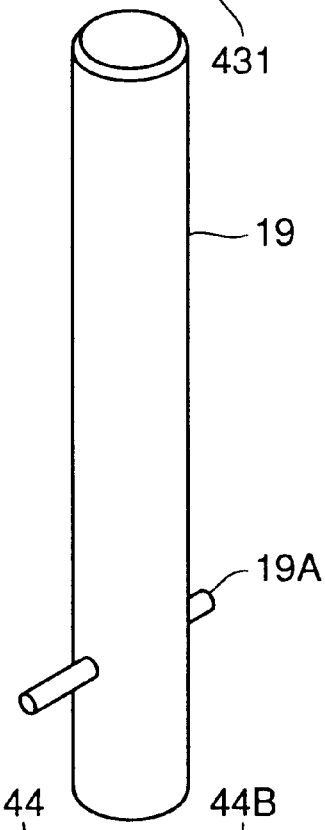
FIG. 4B is a perspective view of a shaft shown in FIG. 3.
Figure 4C:
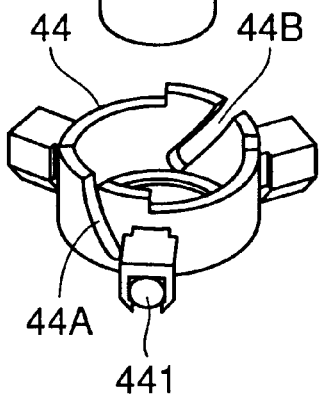
FIG. 4C is a perspective view of a movable magnet holder shown in FIG. 3.
Figure 5:
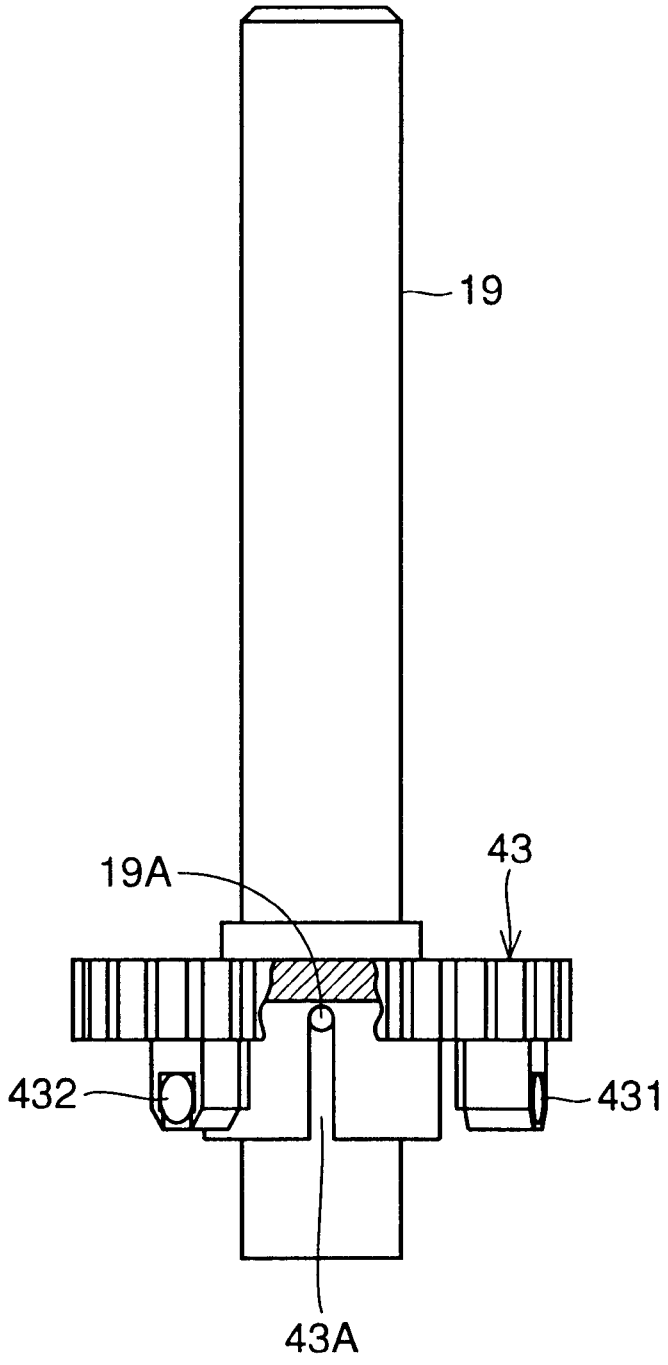
FIG. 5 is a side view of a combination of the shaft and the stationary magnet holder shown in FIG. 3.

Now, a positional relationship among shaft 19, stationary magnet holder 43 and movable magnet holder 44 will be described. Stationary magnet holder 43 and movable magnet holder 44 are arranged in control box 16 of microwave oven 1, being fitted onto shaft 19. FIGS. 4A to 4C collectively show an exploded perspective view of the combination of shaft 19, stationary magnet holder 43 and movable magnet holder 44.

First, referring to FIGS. 4A to 4C and 5, the positional relationship between shaft 19 and stationary magnet holder 43 will be described. Horizontally extending pin 19A passes through the lower portion of shaft 19. Namely, two portions of the pin horizontally protrude from the lower portion of shaft 19 in opposite directions.

Stationary magnet holder 43 has two vertical slot-like cutouts at its side surface. One is a cutout 43A and the other is formed opposite to cutout 43A although not shown. Cutout 43A is formed from the lower end of the side surface of stationary magnet holder 43 in an upward direction. As shown in FIGS. 4A to 4C, stationary magnet holder 43 is combined with shaft 19 by inserting pin 19A to cutout 43A and another cutout which is not shown.

Returning to FIG. 3, stationary magnet holder 43 is downwardly energized by spring 48. Shaft 19 is upwardly energized by spring 46. Namely, the relative positional relationship in the vertical direction of shaft 19 and stationary magnet holder 43 is affected by magnitudes of the energizing forces of springs 48 and 46. The vertical positional relationship also affects the weight of food 17 placed on turn table 15. Note that cutout 43A and the cutout not shown are linearly formed in the vertical direction. Thus, the variation in the weight of food 17 only changes the vertical positional relationship between shaft 19 and stationary magnet holder 43, and stationary magnet holder 43 would not horizontally rotate with respect to shaft 19.

Stationary magnet holder 43 has three magnets 431, 432 and 433 (magnet 433 is not shown in FIG. 5) at regular intervals at its side surface. Since the variation in the weight of food 17 does not cause horizontal rotation of stationary magnet holder 43 with respect to shaft 19 as described above, even if the weight of food 17 varies, the horizontal positional relationship among magnets 431, 432, 433 and pin 19A would not change.

Now, referring to FIGS. 4A to 4C, 6 and 7, the positional relationship between shaft 19 and movable magnet holder 44 will be described. Movable magnet holder 44 has two cutouts (cutouts 44A and 44B) at its side surface. Note that both of cutouts 44A and 44B are formed at the side surface of movable magnet holder 44 in a spiral manner. Cutouts 44A and 44B are formed from the upper end of the side surface of movable magnet holder 44 in a downward direction. As mainly shown in FIGS. 4A to 4C, movable magnet holder 44 is combined with shaft 19 by inserting pin 19A into cutouts 44A and 44B from below.

Figure 6:
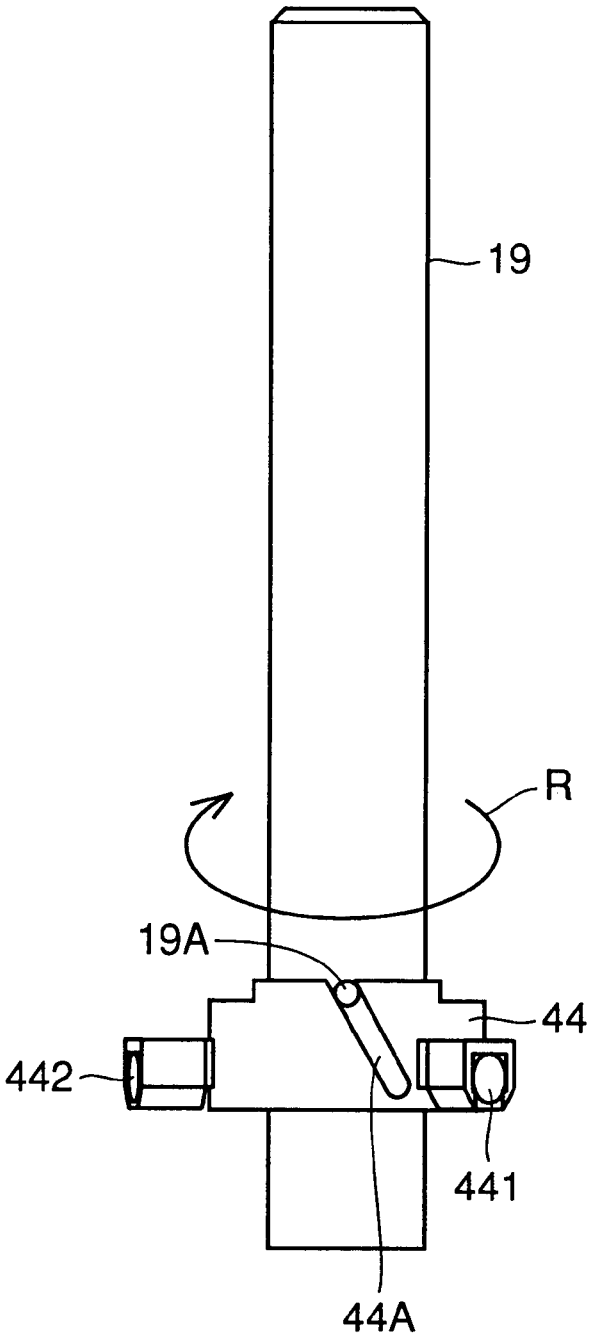
FIG. 6 is a side view of a combination of the shaft and the movable magnet holder shown in FIG. 3.
Figure 7:
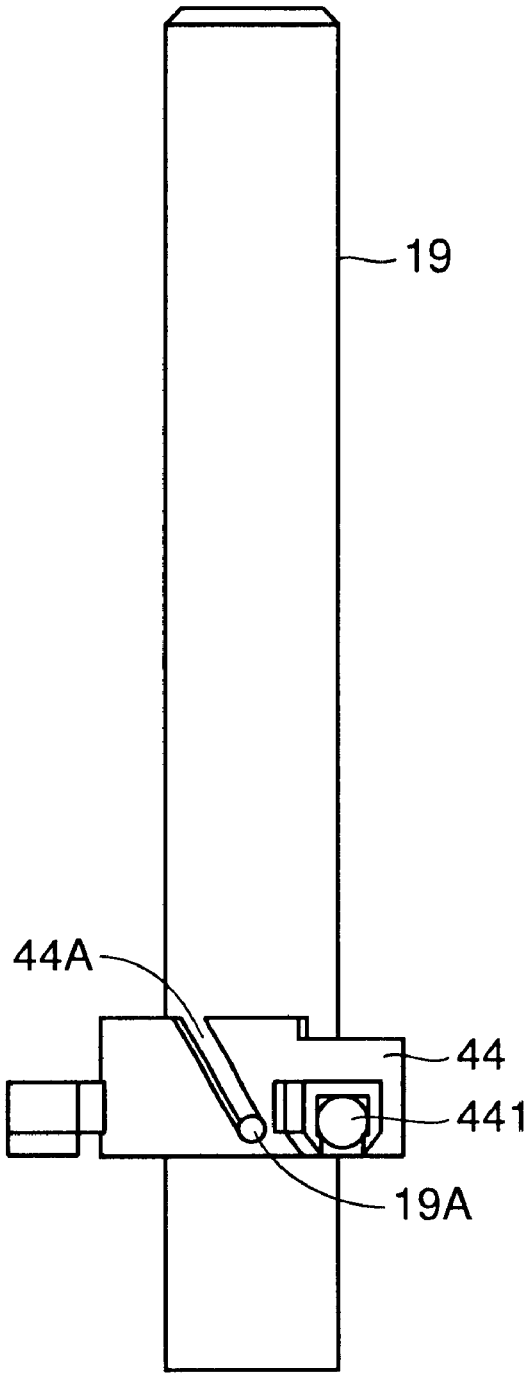
FIG. 7 is a side view of a combination of the shaft and the movable magnet holder shown in FIG. 3.

Returning to FIG. 3, movable magnet holder 44 is energized downwardly by spring 48, and shaft 19 is upwardly energized by spring 46. The relative vertical positional relationship between shaft 19 and movable magnet holder 44 is affected by the weight of food 17 placed on turn table 15. Cutouts 44A and 44B are formed in a spiral manner. Thus, as the weight of food 17 varies, the vertical positional relationship between shaft 19 and movable magnet holder 44 changes and, accordingly, movable magnet holder 44 horizontally rotates with respect to shaft 19. Specifically, if shaft 19 and movable magnet holder 44 are positioned as shown in FIG. 6, if the weight of food 17 increases, the positional relationship turns to that shown in FIG. 7. Namely, movable magnet holder 44 upwardly moves and rotates in an R direction with respect to shaft 19 from the position shown in FIG. 6.

Movable magnet holder 44 has three magnets 441, 442 and 443 (magnet 443 is not shown in FIG. 6) at regular intervals on its side surface. As described above, since variation in the weight of food 17 causes horizontal rotation of movable magnet holder 44 with respect to shaft 19, if the weight of food 17 varies, the positional relationship among magnets 441, 442, 443 and pin 19A changes in the horizontal direction.

As described above, although the variation in the weight of food 17 would not change the positional relationship among magnets 431, 432, 433 and pin 19A in the horizontal direction, it would change the positional relationship among magnets 441, 442, 443 and pin 19A. Microwave oven 1 makes use of this for detecting the weight of food 17.

Now, referring to FIGS. 3 to 8, detection of the weight of food 17 using magnets 431, 432, 433 as well as magnets 441, 442, 443 will be described in greater detail.

Figure 8:
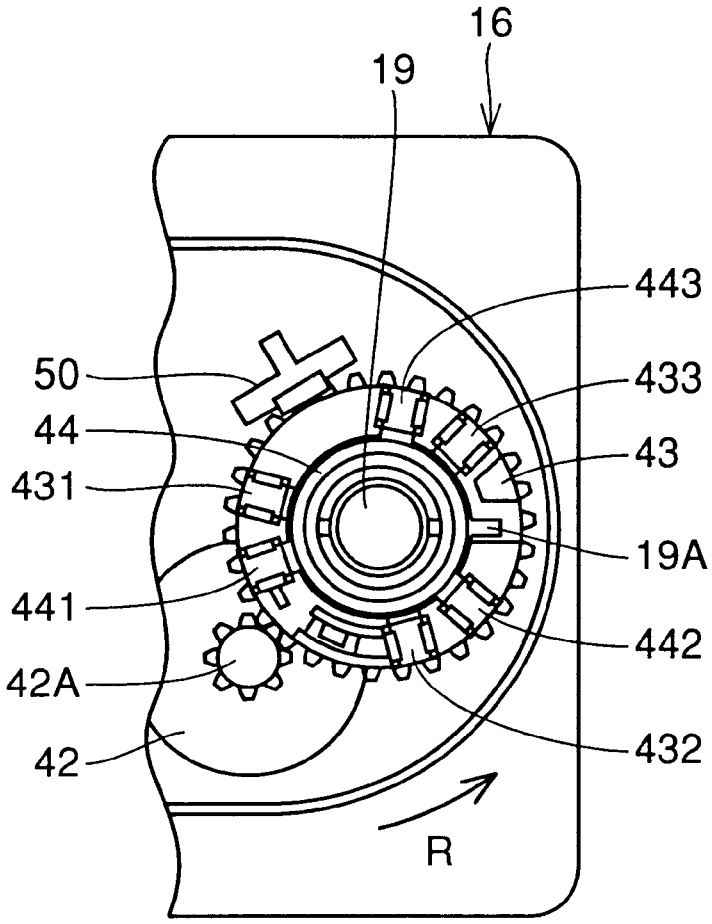
FIG. 8 is a partial bottom view of the turn table control box shown in FIG. 2.

Magnets 431, 432 and 433 are respectively positioned adjacent to magnets 441, 442 and 443 at the same interval. If the weight of food 17 increases, only magnets 441, 442 and 443 move a distance according to the weight in the R direction ("R" in FIG. 6 and that in FIG. 8 represent the same direction) in the drawings with respect to pin 19A. Thus, if the weight of food 17 varies, the interval between magnets 431, 432, 433 and magnets 441, 442, 443 changes in accordance with an amount of the variation in weight. The weight of food 17 can be detected based on the variation in interval.

A hole IC 50 is provided for detecting the above mentioned interval of the magnets.

Magnets 431, 432, 433 and magnets 441, 442, 443 are positioned at the same height. Hole IC 50 is provided to allow magnets 431, 432, 433 to be respectively opposite to magnets 441, 442, 443, at the same distance, as shaft 19 rotates. A prescribed voltage is applied to hole IC 50 and, if it is positioned opposite to any of magnets 431, 432, 433 and magnets 441, 442, 443, it changes its output. The change in time interval of the output from hole IC 50 is used for the detection of the interval of the magnets.

Figure 9:
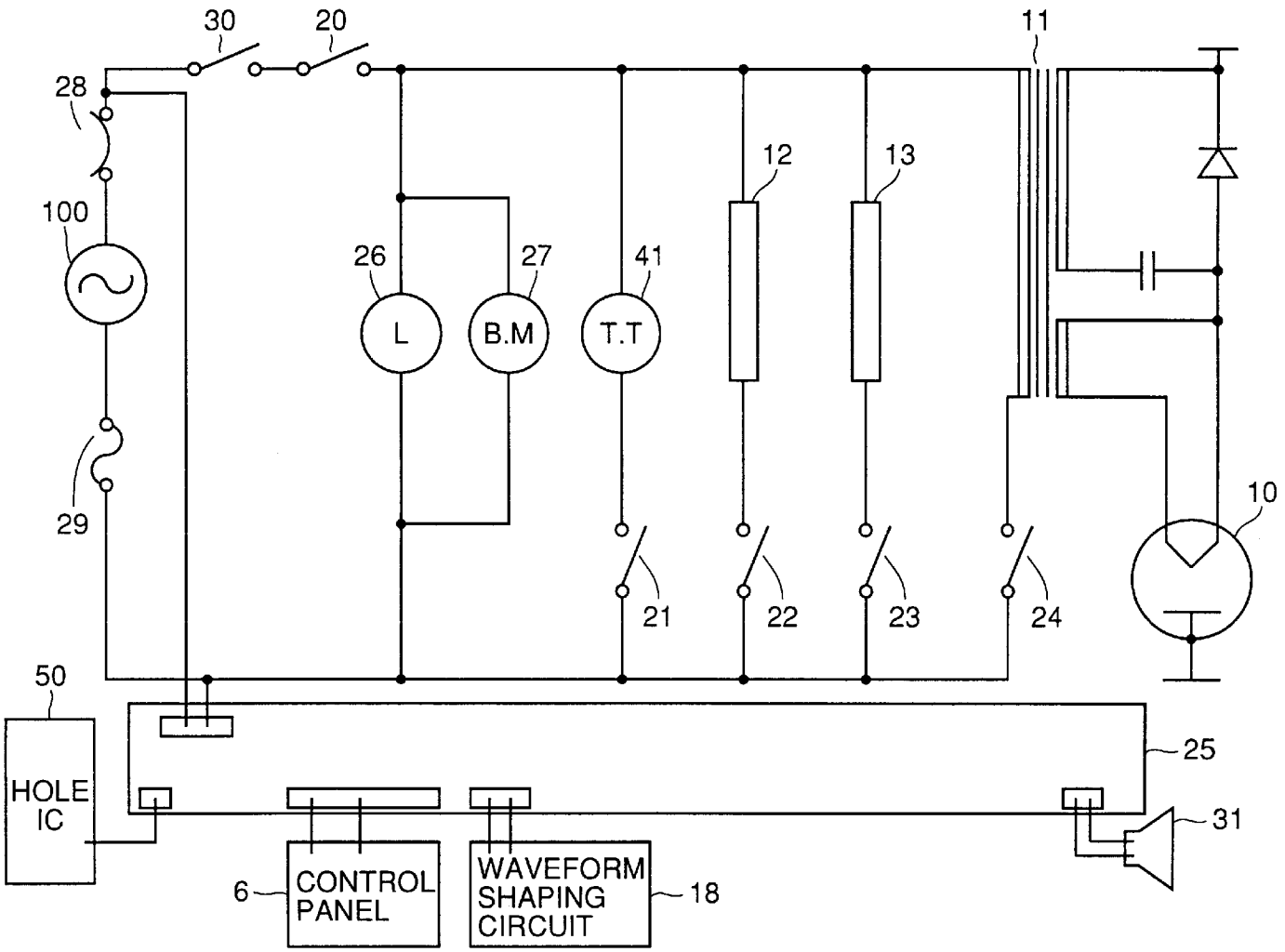
FIG. 9 is a diagram schematically showing an electrical structure of the microwave oven shown in FIGS. 1A and 1B.

FIG. 9 is a diagram schematically showing an electric circuit of microwave oven 1. Microwave oven 1 is provided with a control circuit 25 including a microcomputer for controlling the operation of microwave oven 1. Control circuit 25 is connected to control panel 6 for controlling microwave oven 1 in accordance with data or the like input from control panel 6. Note that control panel 6 is provided with a display portion for displaying prescribed information, and control circuit 25 can control the display content.

Control circuit 25 is connected to a waveform shaping circuit 18. Waveform shaping circuit 18 is provided for counting a frequency of a commercially available power supply source (AC power supply source 100 which will later be described).

Microwave oven 1 further includes relays 21 to 23 for respectively turning on turn table motor 41, upper heater 12 and lower heater 13. Further, microwave oven 1 has a relay 24 to be connected to transformer 11, heat chamber light 26 for illuminating the previously mentioned heat chamber 5 with light, and a motor 27 for driving a fan for cooling magnetron 10.

Microwave oven 1 further includes a door switch 30 for closing a circuit shown in FIG. 9 when door 3 is closed, and a relay 20 to be connected to heat chamber light 26 and motor 27. Opening/closing of relay 20 is controlled by control circuit 25. Opening/closing of the previously mentioned relays 21 to 24 are also controlled by control circuit 25.

Microwave oven 1 is connected to AC power supply source 100 for supplying electric power to the entire circuit shown in FIG. 9. A fuse 29 is a temperature fuse which opens a circuit when a portion of microwave oven 1 other than heat chamber 5 attains to an unusual high temperature (of for example 20° C.) for preventing microwave oven 1 from overheating.

Control circuit 25 is connected to a speaker 31 and hole IC 50. Speaker 31 is provided for notifying a user that cooking is finished.

Figure 10:
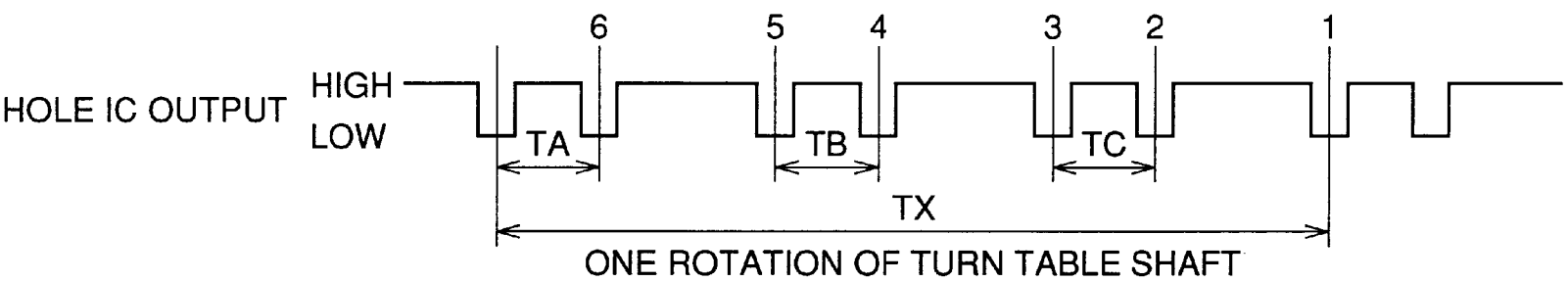
FIG. 10 is a diagram shown in conjuction with a pulse signal output from a hole IC (Integrated Circuit) to a control circuit shown in FIG. 9.

FIG. 10 shows an exemplary output of hole IC 50 detected by control circuit 25. Hole IC 50 outputs six pulse signals at a low level in response to a fact that it is positioned opposite to any of magnets 431, 441, 432, 442, 433, 443 during one rotation of shaft 19 of turn table 15. The intervals of magnets 431 and 441, 432 and 442, and 433 and 443 respectively correspond to TA, TB, and TC. TA, TB and TC are basically the same.

Control circuit 25 detects the weight of food 17 using TA, TB and TC. Specifically, it solves the following equations (1) and (2) with TA, TB and TC. In other words, it preliminary computes and stores $\sigma(\sigma_0)$ when the weight of food 17 is 0 gram (i.e., food 17 is not placed) and $\sigma(\sigma_{1000})$ when the weight of food 17 is 1000 grams, in accordance with equation (1). Then, by assigning, to equation (2), $\sigma(\sigma_n)$ computed with TA, TB and TC which have been detected at that point, the weight (w grams) of food 17 is computed. Note that TX in equation (1) represents a rotation period of turn table 15.

$$\sigma = \frac{TA + TB + TC}{TX} \tag{1}$$

$$w = \frac{\sigma_n - \sigma_0}{\sigma_{1000} - \sigma_0} \times 1000 \tag{2}$$

Figure 11:
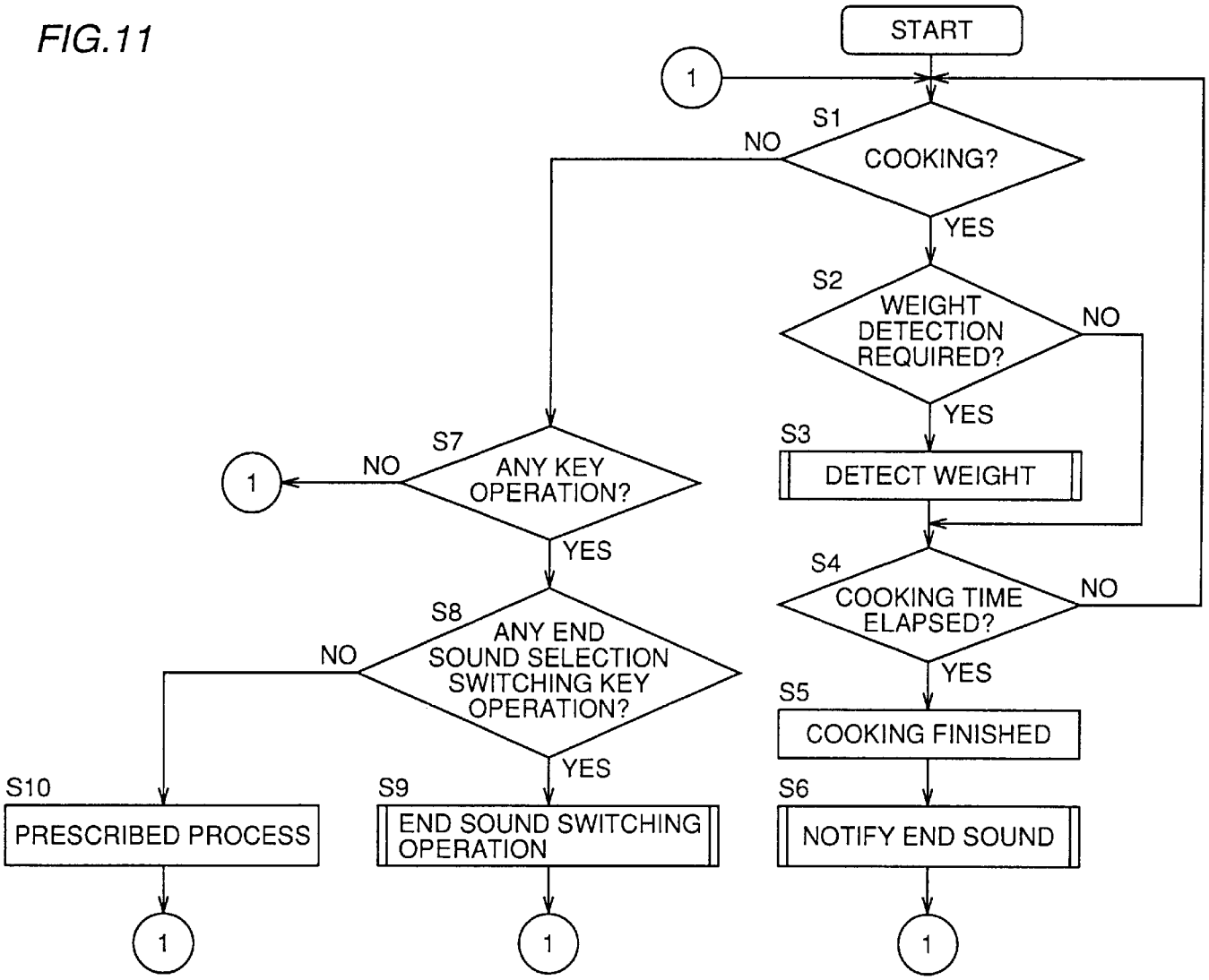
FIG. 11 is a flow chart of a main routine executed by the control circuit shown in FIG. 9.

Next, a process executed by control circuit 25 will be described. FIG. 11 is a flow chart of a main routine executed by control circuit 25.

When power is turned on, control circuit 25 determines if microwave oven 1 is in operation (cooking) in S1 after a prescribed initialization is performed. If it determines that microwave oven 1 is in operation, it proceeds to S2. If it determines microwave oven 1 is not in operation, it proceeds to S7.

In S2, control circuit 25 determines if microwave oven 1 is currently required to detect the weight of food 17. If YES, it proceeds to S3 and further proceeds to S4 after performing the weight detecting process. On the other hand, if NO, it jumps to S4. For example, the weight of food 17 needs to be detected when microwave oven 1 is in operation of automatic cooking by detecting the weight of food 17 and automatically determining a cooking time or the like base on the weight of food 17. The weight detecting process in S3 will later be described.

In S4, control circuit 25 determines if a cooking time is elapsed. If NO, it returns to S1. If YES, it proceeds to S5 to stop heating, further proceeds to S6 to generate prescribed end sounds for notifying the end of cooking by sounds, and then returns to S1.

On the other hand, in S7, control circuit 25 determines if any key operation has occurred at control panel 6. If YES, it proceeds to S8. If NO, it returns to S1.

In S8, control circuit 25 determines if the key operation detected in S7 has been a key (end sound selection switching key) operation for switching the end sound generated in S6. If YES, an end sound switching operation process is performed in S9 and the process returns to S1. On the other hand, if NO, a prescribed process in accordance with the key operation is performed in S10 and the process returns to S1. Note that the end sound switching operation process performed in S9 is a process of setting the end sound generated in S6, which will later be described.

Figure 12:
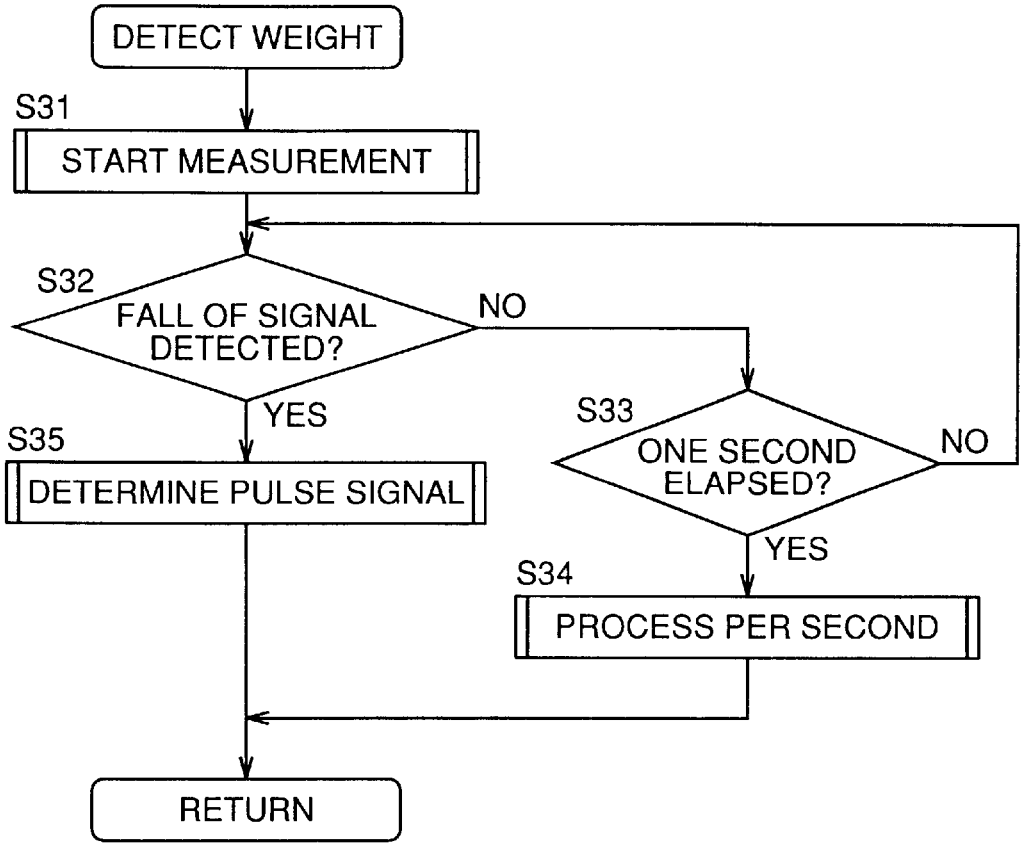
FIG. 12 is a flow chart of a subroutine of a weight detecting process shown in FIG. 11.

Next, the weight detecting process in S3 will be described. FIG. 12 is a flow chart of a subroutine of the weight detecting process.

First, control circuit 25 performs a measurement starting process in S31, and it proceeds to S32. The measurement starting process will later be described.

Then, control circuit 25 determines if the fall of a signal input from hole IC 50 has been detected in S32. Here, the fall of a signal refers to switching from HIGH to LOW level of the output from hole IC 50 (see FIG. 10). If control circuit 25 determines the fall has not been detected, it proceeds to S33. If it determines the fall has been detected, it proceeds to S35.

In S33, control circuit 25 determines if one second is elapsed after the measurement starting process is performed in S31 or the previous process in S34 is performed. If YES, control circuit 25 performs a process per second in S34 and returns. If not, it directly returns to S32. Note that the process per second performed in S34 will later be described.

On the other hand, in S35, control circuit 25 performs a pulse signal determining process for determining various elements of the pulse signal based on the fall of the signal detected in S32, and then returns. Note that the pulse signal determining process performed in S35 will later be described.

Figure 13:
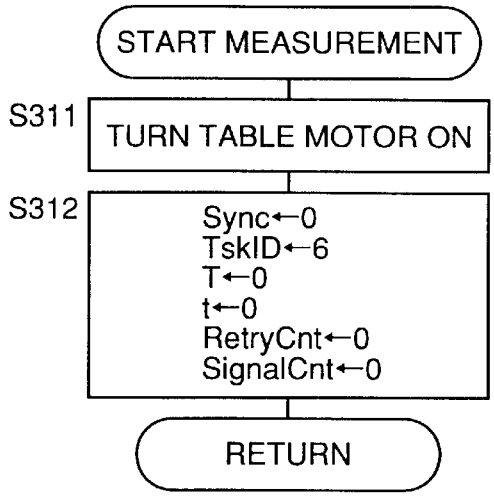
FIG. 13 is a flow chart of a subroutine of a measurement starting process shown in FIG. 12.

Now, the measurement starting process performed in S31 will be described in detail. FIG. 13 is a flow chart of a subroutine of the measurement starting process.

In the measurement starting process, in S311, control circuit 25 drives turn table motor 41 and proceeds to S312.

In S312, control circuit 25 initializes various counters, registers and flags, and then returns. Here, names of the counters, registers and flags initialized in S312 are given in the following table 1 along with their brief descriptions.

TABLE 1

| Name | Description |
|---|---|
| Sync | A flag indicating if a weight of food is measured. Cleared if the weight of food is being measured. |
| TskID | A counter corresponding to the number of pulse signals in a rotation period of a turn table of a given turn. An initial value is 6 and is decreased every time a pulse signal is detected. Numbers (1 to 6) denoted above the signal in FIG. 10 correspond to the count values. |
| T | A register for deriving a time corresponding to the rotation period of the turn table. |
| t | A register for solving a conversion equation TA + TB + TC in equation (1). |
| RetryCnt | A counter for storing a frequency of event that the pulse signal is not properly detected. |
| SignalCnt | A counter for storing a frequency of event that no change is detected for the output from a hole IC. |

Figure 14:
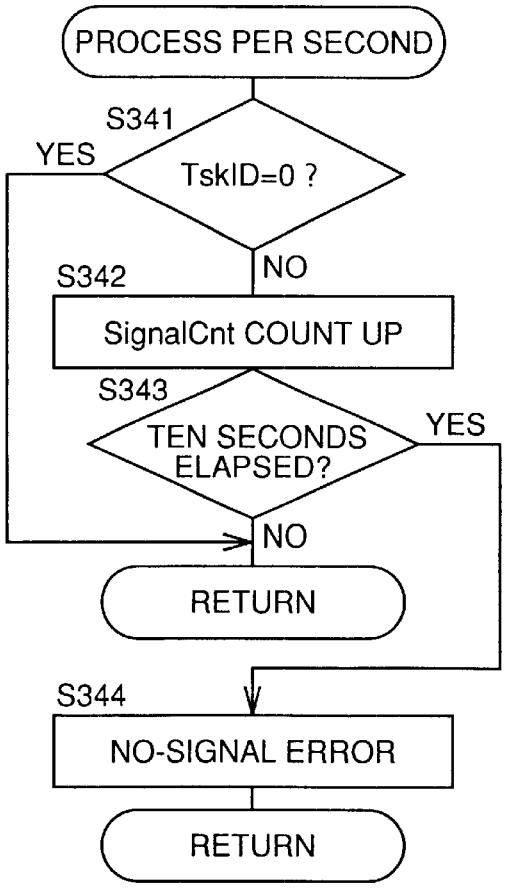
FIG. 14 is a flow chart of a subroutine of a process per second shown in FIG. 12.

Now, the process per second performed in S34 will be described in detail. FIG. 14 is a flow chart of a subroutine of the process per second.

In the process per second, in S341, control circuit 25 determines if a value of a counter TskID is 0. If control circuit 25 determines that the value is 0, it directly returns. On the other hand, if it determines the value is not 0, in S342, it increases the value of counter Signalcnt by 1 and updates the value to proceed to S343.

In S343, control circuit 25 determines if the fall has not been detected in S32 for 10 seconds. Specifically, the determination is made by determining if counter SignalCnt has attained to 10. Note that the process per second is performed every second with the fall of the output from hole IC 50 not detected. If the fall of the output from hole IC 50 is detected, counter SignalCnt is cleared in the pulse signal determining process (SA2 which will later be described) in S35. Thus, the fact that counter SignalCnt has attained to 10 means that the fall has not been detected for 10 seconds in S32.

Then, in S343, if control circuit 25 determines that 10 seconds have passed, it proceeds to S344, performs a no-signal error process, and returns. On the other hand, if it determines that ten seconds have not passed, it returns.

The no-signal error process in S344 refers to a process of notifying an error by display or sounds when the fall of the signal is not detected when it should be detected. In the present embodiment, if turn table 15 rotates in S311 (see FIG. 13), generally, one rotation 10 or 12 seconds. Accordingly, hole IC 50 would detect any of magnets 431 to 433 once every 3 to 4 seconds. If there is no change in the output of hole IC 50 for 10 seconds, it follows that signals are not properly output from hole IC 50 to control circuit 25 or turn table 15 is not properly rotating. In the present embodiment, the no-signal error process in S344 is performed in such a case for notifying the error. In this situation, it would be realized that various errors are caused. Accordingly, in the no-signal error process in S344, the cooking process may be interrupted at that point of time or stopped in addition to the notification of the error.

Figure 15:
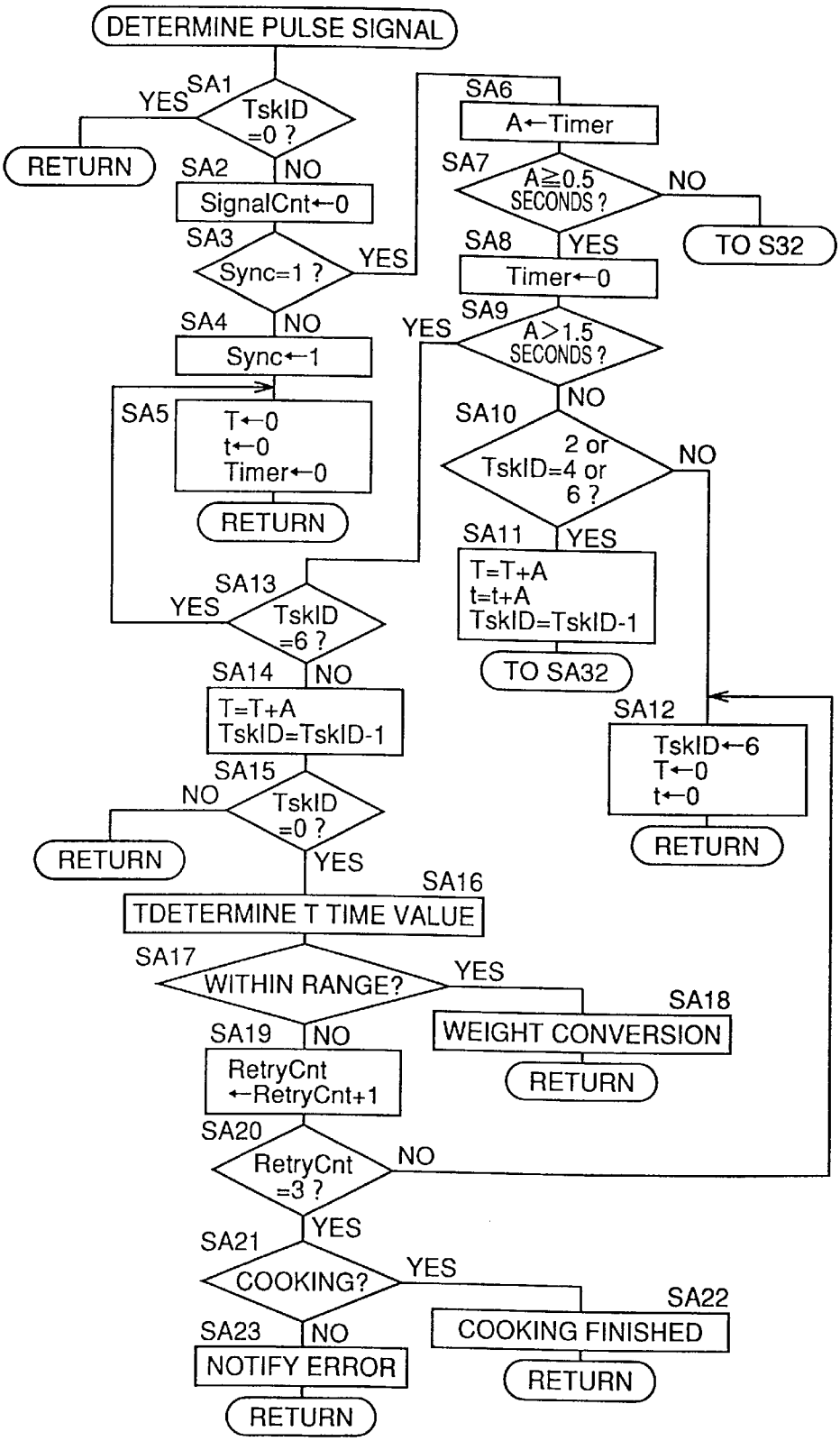
FIG. 15 is a flow chart of a subroutine of a pulse signal determining process shown in FIG. 12.

Next, the pulse signal determining process in S35 will be described in detail. FIG. 15 is a flow chart of a subroutine of the pulse signal determining process.

In the pulse signal determining process, control circuit 25 determines if the value of counter TskID is 0 in SA1. If it determines that the value is 0, it returns. If not, it proceeds to SA2.

In SA2, control circuit 25 resets counter SignalCnt to 0 and proceeds to SA3.

In SA3, it determines if a flag Sync is set. If it determines that flag Sync is set, it proceeds to SA6. If it determines that flag Sync is reset, it proceeds to SA4. In SA4, it sets flag Sync and proceeds to SA5.

In SA5, it resets the stored values of register T and register t to 0, resets a timer Timer, and returns. The timer Timer measures a time interval between the fall of the pulse signal in a given period and the fall in the next period.

On the other hand, control circuit 25 stores the value of timer Timer at that time in register A and proceeds to SA7. Register A is provided in control circuit 25.

The timer Timer is reset every time the fall of the signal from hole IC 50 is detected. This is because that the measurement starting process (see FIGS. 12 and 13) is performed between the detection of the fall in the given period and that in the next period. Then, the value of timer Timer is stored in SA6, so that the time interval between the pulse signals in the previous period and the current period is stored in register A.

In SA7, control circuit 25 determines if the value stored in register A is at least 0.5 seconds. If it determines that the value is at least 0.5, it proceeds to SA8. If not, it returns to S32 (see FIG. 12). In the process of SA7, if the interval between two consecutive pulse signals is shorter than a prescribed interval, then, it means that no process has been performed on the second pulse signal of these two pulse signals. Note that, in the present embodiment, the prescribed interval refers to a time that hole IC 50 takes to move from a position opposite to any of the magnet of stationary magnet holder 43 to a position opposite to the counterpart magnet of movable magnet holder 44 when these corresponding magnets are considered to be in the closest position. In the present embodiment, if control signal 25 detects the pulse signal at an unusual time interval after detection of the previous pulse signal, it ignores that pulse signal which was received later. Thus, the pulse signal caused by the external noise can be distinguished from that used for the detection of the weight of food 17 and ignored. Accordingly, microwave oven 1 can detect the weight of food 17 more accurately.

Control circuit 25 resets timer Timer in SA8 and proceeds to SA9. In SA9, control circuit 25 determines if the value stored in register A is greater than 1.5 seconds. If the value is determined greater than 1.5 seconds, control circuit 25 proceeds to SA13. If not, it proceeds to SA10.

In SA10, control circuit 25 determines if the value of counter TskID is any of 2, 4, and 6. If the value is determined any of 2, 4, and 6, control circuit 25 proceeds to SA11. If not, control circuit 25 proceeds to SA12.

In SA11, control circuit 25 adds the value of register A, stored in SA6 immediately before, to the stored values of registers T and t. Further, it subtracts 1 from the value of counter TskID and returns to SA32 (see FIG. 12).

On the other hand, if it determines that the value of counter TskID is not any of 2, 4, and 6 in SA10, control circuit 25 resets counter TskID, register T and register t in SA12 and returns.

Here, the description of the event that the value of counter TskID is any of 2, 4, and 6 will be given with reference to FIG. 10. In FIG. 10, the pulse signals are detected sequentially in the rightward direction. Namely, the pulse signals are detected in an order of 6, 5, 4, 3, 2, and 1, using the numerals of these pulse signals. Note that the numeral of the pulse signal corresponds to the value of counter TskID before the subtraction in SA11. In other words, the event that the value of counter TskID is any of 2, 4, and 6 as determined in SA10 refers to the case where the time interval between that point of time and the detection of the pulse signal immediately before is any of TA, TB, and TC. Then, when the value of register A is added to the stored value of register t in SA11, the addition is performed on storage locations respectively corresponding to $t_3$, $t_2$, and $t_1$, if the values of counter TskID are 2, 4, and, 6.

Still referring to FIG. 10, six pulse signals, corresponding to magnets 431 to 433 and 441 to 443, are detected during one rotation of turn table 15. Magnets 431 to 433 and 441 to 443 are positioned such that each of TA, TB, and TC is shorter than the other periods. Namely, a time interval (corresponding to TB) between pulse signals "5" and "4" in FIG. 10 is shorter than that between pulse signals "6" and "5" or pulse signals "4" and "3." More specifically, TA, TB, and TC are at most 1.5 seconds in the present embodiment.

On the other hand, in the rotation period of turn table 15, magnets 431 to 433 and 441 to 443 are positioned at regular intervals at the peripheries of stationary magnet holder 43 and movable magnet holder 44. Thus, TA, TB, and TC are the same. In addition, the time intervals between the pulse signals other than TA, TB, and TC are the same. The rotation period of turn table 15 is at least 10 seconds in the present embodiment, where TA, TB, and TC are all at most 1.5 seconds. Accordingly, the time intervals between pulse signals other than TA, TB, and TC all exceed 1.5 seconds even in the shortest case as defined by x in the following equation (3).

$$x=\{10-(1.5\times 3)\}\div 3>1.5 \quad (3)$$

From the above equation, if the time stored in register A, i.e., the interval between the pulse signals is at most 1.5 seconds, the value of counter TskID at that point of time would be any of 2, 4, and 6. If it exceeds 1.5 seconds, the value of counter TskID at that point of time would be any of 1, 3, and 5. Based on this, the determination is made in SA9.

Note that the value of counter TskID is further tested in SA10 to determine if the time interval between the pulse signals corresponds to the value of counter TskID. If the time interval corresponds to the value of counter TskID, the process in SA11 stores the time interval in register t. If not, however, the register, counter and the like are reset in SA12 and the detection of the pulse signals is retried.

Control circuit 25 determines if the value of counter TskID is 6 in SA13. If it determines that the value is 6, it returns to SA5. If not, it proceeds to SA14.

In SA14, control circuit 25 adds the value of register A to the value of register T for storage. In addition, it decreases the value of counter TskID by 1 and updates the value, and then proceeds to SA15. When the process of SA14 or SA11 is performed until the value of counter TskID decreases from 6 to 0, the time required for one rotation of turn table 15 is stored in register T.

Control circuit 25 determines if the value of counter TskID is 0 is SA15. If it determines that the value is other than 0, it returns. If it determines the value is 0, it proceeds to SA16.

In SA16, control circuit 25 checks the stored value in register T. In SA17, it determines if the stored value falls within a range acceptable as a time for one rotation of turn table 15. If the value is in the acceptable range, it proceeds to SA18, converts the stored value in register t to the weight of food 17 using the above equations (1) and (2), and returns. On the other hand, if it determines the value is not within the acceptable range, it proceeds to SA19. Note that if the value in register T is smaller than a lower limit of the acceptable range, it means that the interval of the pulse signals is shorter than a usual interval. In this case, the detection of the pulse signals is for example retried SA7, SA10, or SA12. If it is determined that the value in register T is greater than an upper limit of the acceptable range in SA17, it means that a time longer than the acceptable time was required for one rotation of the turn table 15 to detect six pulse signals.

In SA19, control circuit 25 increases the value of counter RetryCnt by 1 and updates the value, and proceeds to SA20. In SA20, control circuit 25 determines if the value of counter RetryCnt has attained to 3. If not, it returns to SA12 and retries detection of the pulse signals. On the other hand, if it determines the value has attained to 3, it proceeds to SA21.

In SA21, it determines if microwave oven 1 is in operation. If YES, it ends the operation in SA22 and returns. If not, it notifies an error in SA23 and returns.

In the present embodiment, control circuit 25 proceeds from SA20 to SA12 to retry the detection of the weight of food 17 using the interval of pulse signals if six pulse signals cannot be received within the acceptable time for one rotation of turn table 15 until such event successively occurs with a specific frequency (three times). If such event successively occurs with a frequency exceeding the above mentioned specific frequency, heating is stopped or such unusual event will be notified.

Counter RetryCnt is reset in the measurement starting process described with reference to FIG. 13. Namely, in the present embodiment, in SA16, SA17 and SA19 to SA23, if the event that the detection of six pulse signals takes a time longer than the acceptable time for one rotation of turn table 15 successively occurs three times, cooking is stopped (SA22), or the error is notified (SA23). Note that the error can be notified further in SA22, i.e., the error can be notified after cooking is stopped.

Figure 16:
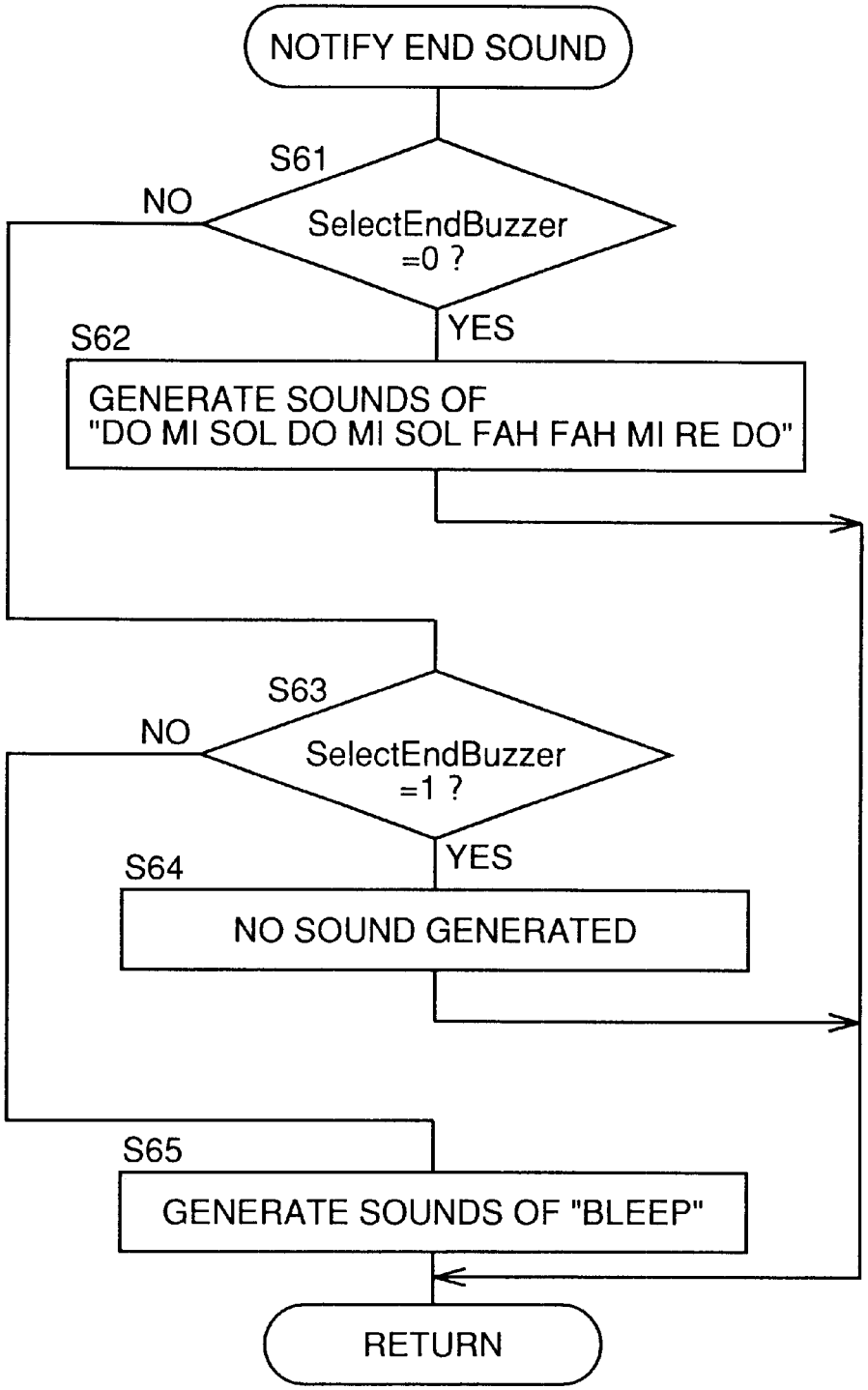
FIG. 16 is a flow chart of a subroutine of an end sound notifying process shown in FIG. 11.

Now, the end sound notifying process of S6 will be described in detail. FIG. 16 is a flow chart of a subroutine of the end sound notifying process.

In the end sound notifying process, control circuit 25 determines if the value of a register SelectEndBuzzer is 0 in S61. Here, register SelectEndBuzzer will be described.

Register SelectEndBuzzer has a value associated with the end sound. Microwave oven 1 has some choice as to the selection of the end sound. The choice includes a melody using a scale such as "do mi sol do mi sol fah fah mi re do," no sound, and electronic sounds such as "peep peep peep." Register SelectEndBuzzer may take any of three different values 0, 1, and 2. These values respectively correspond to the above mentioned three types of end sounds. More specifically, 0, 1, and 2 respectively correspond to the melody, no sound, and electronic sounds. The value of register SelectEndBuzzer is set by a user in the end sound switching operation process which will later be described.

Then, if control circuit 25 determines that the value of register SelectEndBuzzer is 0, it generates the above mentioned melody in S62 for a prescribed time period and returns. If not, it proceeds to S63.

In S63, control circuit 25 determines if the value of register SelectEndBuzzer is 1. If it determines that the value is 1, it notifies by display that cooking is finished without generating sounds for a prescribed time period in S64, and returns. If not, it determines the value of register SelectEndBuzzer is 2 to generate electronic sounds in S65 for a prescribed time period and returns.

Figure 17:
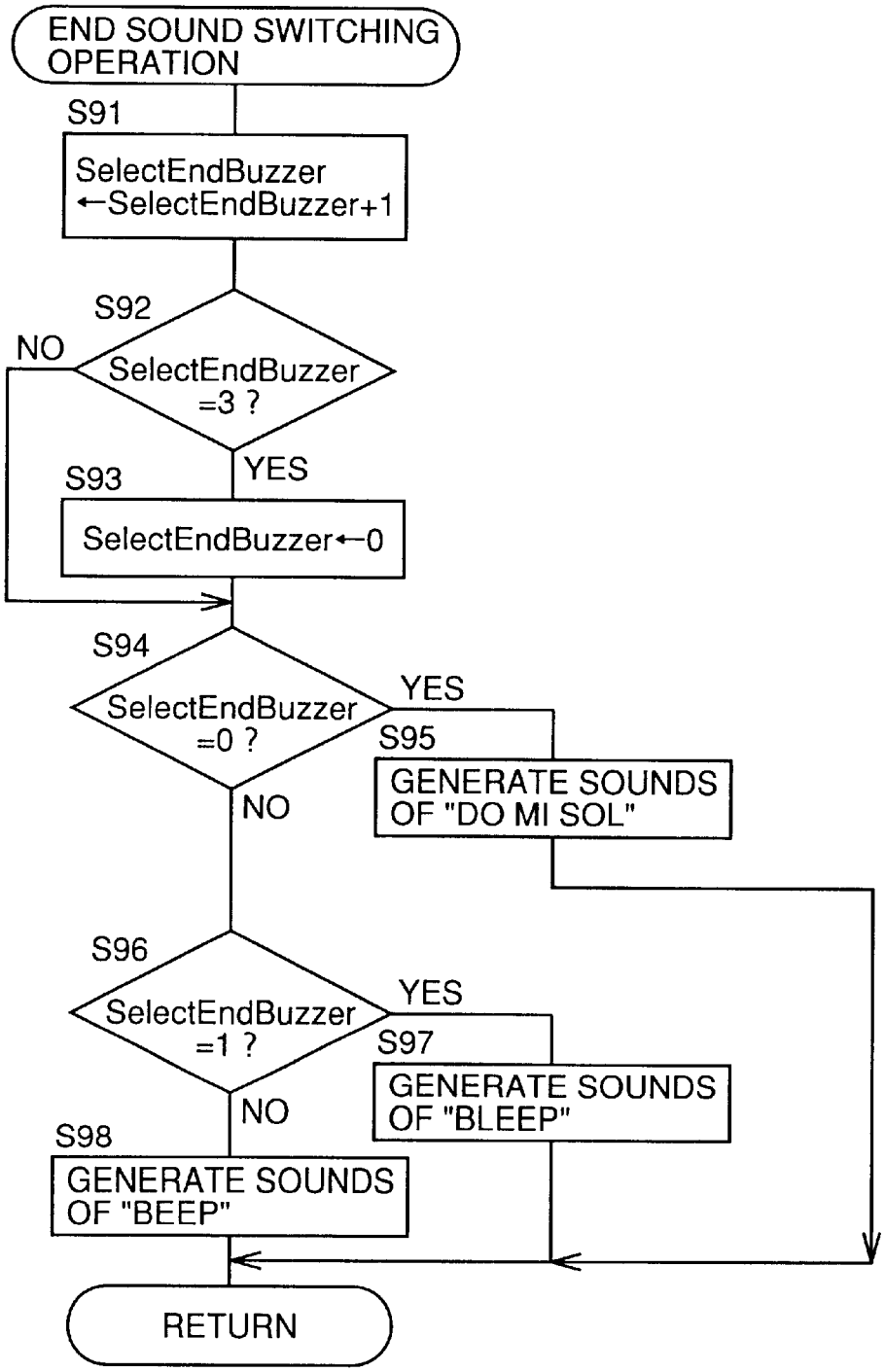
FIG. 17 is a flow chart of a subroutine of an end sound switching operation process shown in FIG. 11.

The end sound switching operation process of S9 will be described in detail. FIG. 17 is a flow chart of a subroutine of the end sound switching operation process.

In the end sound switching operation process, control circuit 25 increases the value of register SelectEndBuzzer by 1 and updates the value in S91 in response to the fact that the end sound selecting switch key has been pressed in S8 (FIG. 11) and proceeds to S92.

In S92, control circuit 25 determines if the value of register SelectEndBuzzer has attained to 3 as a result of the addition of 1 in S91. If control circuit 25 determines that the value has attained to 3, it resets the value of register SelectEndBuzzer to 0 and proceeds to S94. If not, it jumps to S94.

Control circuit 25 determines if the value of register SelectEndBuzzer is 0 in S94. If it determines that the value is 0, control circuit 25 generates the above mentioned melody in S95 and returns. On the other hand, if it determines that the value is not 0, it proceeds to S96, and determines if the value of register SelectEndBuzzer is 1. If it determines that the value is 1, it generates electronic sounds ("bleep bleep" and the like) different from the above mentioned electronic sounds that is employed when the end sound when the value of register SelectEndBuzzer is 0 and returns. If it determines that the value is not 0, it generates the above mentioned electronic sounds and returns.

In the present embodiment, every time the end sound switching operation process is performed, any of the melody, no sound, and electronic sounds is selectively set as the end sound. Namely, in the end sound switching operation process in a given cycle, if the electronic sounds are set as the end sounds, when the end sound switching operation process is performed based on the determination that the end sound switching operation key has been pressed in S8 next time, the melody is set as the end sound.

In the above described end sound switching operation process, the currently set end sound is temporarily generated. If it is set that no end sound is to be generated, i.e., the value of register SelectEndBuzzer is set to 1 and the end sound is set as no sound, the electronic sound different from that employed as the end sound when the value of register SelectEndBuzzer is 0 is generated. In other words, in the present embodiment, when the end sound is set, that end sound is generated as the set type of the end sound. However, even if no sound is set, the electronic sound corresponding to that is generated. As a result, the user can more easily realize which kind of end sound has been set.

In the present embodiment, setting of the end sound has been described as setting of the sound to be generated. In the present embodiment, at the time other than when the sound is inherently generated (when cooking is finished), i.e., when setting the sound, the sound corresponding to the set sound is generated (if the end sound is melody or electronic sounds, that end sound is generated, but if the end sound is no sound, the electronic sounds other than that generated as the end sound are generated). Thus, the generation of the sound corresponding to the set sound not only when the sound is inherently generated but also when setting the sound is restricted to the case of the end sound. It may also be applied to the generation of the sound in notifying the error or the like.

In the embodiment described above, the intervals between magnets 431 and 441, 432 and 442, 433 and 443 change according to the weight of food 17. As the intervals change, a magnitude of a magnetic force applied from hole IC 50 during one rotation of turn table 15 changes according to the weight of food 17. Thus, a combination of shaft 19, stationary magnet holder 43 and movable magnet holder 44 constitutes a weight indicating portion.

A manner of outputting pulse signals from hole IC 50 changes according to the change in the intervals of the above mentioned magnets. Thus, hole IC 50 constitutes a signal output portion.

In the present embodiment, control circuit 25 computes the weight of food 17 using the detected output from hole IC 50 and in accordance with equations (1) and (2). Control circuit 25 can control on/off of magnetron 10, heaters 12, 13 or the like. Thus, control circuit 25 constitutes a weight determining portion and heating controlling portion. In the pulse signal determining process described with reference to FIG. 15, if a frequency of receiving pulse signals in the acceptable time for the rotation period of turn table 15 is less than a prescribed frequency (six times) in S17, control circuit 25 does not determine the weight of food 17 immediately in SA18, but retries detection of the pulse signals (SA12). Further, if the event that the frequency of receiving is less than the prescribed frequency occurs successively three times, cooking is stopped (SA22) or an error is notified (SA23). Note that if the frequency of receiving the pulse signals in the time acceptable for the rotation period of turn table 15 exceeds the above mentioned prescribed frequency, control circuit 25 may perform a similar process.

In the present embodiment, a display portion of control panel 6, speaker 31 and the like constitute a notifying portion. Further, speaker 31 constitutes a sound generating portion. In the present embodiment, control panel 6 constitutes a sound setting portion.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cooking apparatus including a turn table with food placed thereon and rotating in a prescribed period, comprising:

a weight indicating portion including a magnet, varying a magnetic field intensity in a prescribed position with a prescribed frequency in a rotation period of said turn table, and changing a timing at which said magnetic field intensity in said prescribed position in said rotation period of said turn table varies according to a weight of said food placed on said turn table;

a signal outputting portion outputting pulse signals differently according to the variation in the magnetic field intensity in said prescribed position; and a weight determining portion receiving the signals output from said signal outputting portion for determining said weight of said food in accordance with a timing of receiving said pulse signals in said rotation period of said turn table, said weight determining portion determining the weight of said food only when said pulse signals are received with said prescribed frequency in said rotation period of said turn table.

2. The cooking apparatus according to claim 1, wherein said weight determining portion determines the weight of said food, when said frequency of receiving said pulse signals output from said signal outputting portion in said rotation period of said turn table is less than said prescribed frequency, according to the timing of receiving said pulse signals in a subsequent rotation period of said turn table.

3. The cooking apparatus according to claim 1, further comprising:

a heating portion heating said food to be heated; and a heat controlling portion controlling a heating operation of said heating portion, said heat controlling portion ends said heating operation of said heating portion in an event that said pulse signals output from said signal outputting portion have not been received with said prescribed frequency during one rotation of said turn table after such event successively occurs with a given frequency.

4. The cooking apparatus according to claim 1, further comprising a notifying portion notifying an event that said pulse signals output from said signal outputting portion have not been received with said prescribed frequency during one rotation of said turn table by said weight determining portion after such event successively occurs with a given frequency.

5. The cooking apparatus according to claim 1, further comprising a notifying portion notifying that said weight determining portion cannot determine said weight of said food properly in an event that said pulse signal has never been received from said signal outputting portion in a prescribed period of said weight determining portion.

6. A cooking apparatus including a turn table with food placed thereon and rotating in a prescribed period, comprising:

a weight indicating portion including a magnet, varying a magnetic field intensity in a prescribed position with a prescribed frequency in a rotation period of said turn table, and changing a timing at which said magnetic field intensity in said prescribed position in said rotation period of said turn table according to a weight of said food placed on said turn table;

a signal outputting portion outputting pulse signals differently according to the variation in the magnetic field intensity in said prescribed position; and a weight determining portion receiving the signals output from said signal outputting portion for determining said weight of said food in accordance with a timing of receiving said pulse signals in said rotation period of said turn table, said weight determining portion invalidates, when two different pulse signals are received at an interval shorter than a prescribed time period, reception of the latter one of these two pulse signals.

7. The cooking apparatus according to claim 6, further comprising:

a sound generating portion capable of generating a plurality of different sound patterns preliminary set and generating a sound when a prescribed condition is met; and a sound setting portion setting said sound pattern to be generated by said sound generating portion among said plurality of sound patterns, said sound generating portion generating a sound according to said set sound pattern when said sound pattern is set by said sound setting portion.

8. A method of detecting a weight of food placed on a turn table in a cooking apparatus including a turn table rotating in a prescribed period and a weight indicating portion varying a magnetic field intensity in a prescribed position with a prescribed frequency in a rotation period of said turn table, wherein a timing at which said weight indicating portion varies said magnetic field intensity in said prescribed position changes according to the weight of said food placed on said turn table, comprising the steps of:

outputting pulse signals differently according to the variation in the magnetic field intensity in said prescribed position; and receiving said pulse signals for determining the weight of said food in accordance with a timing of receiving said pulse signal only when a frequency of receiving said pulse signals in said rotation period of said turn table is said prescribed frequency.

9. The method of detecting the weight of food placed on the turn table according to claim 8, wherein if said frequency of receiving the pulse signal in the rotation period of said turn table is less than said prescribed frequency, the weight of said food is determined according to the timing of receiving pulse signals in a subsequent rotation period of said turn table.

10. The method of detecting the weight of food placed on the turn table, according to claim 8, wherein, if an event that said pulse signals have not been received with said prescribed frequency in said one rotation of said turn table successively occurs with a given frequency, a heating operation of said cooking apparatus is stopped.

11. The method of detecting the weight of food placed on the turn table according to claim 8, wherein an event that said pulse signals have not been received with a prescribed frequency during one rotation of said turn table is notified if said event successively occurs with a given frequency.

12. The method of detecting the weight of food placed on the turn table, according to claim 8, wherein, if two different pulse signals are received at an interval shorter than a prescribed time period, reception of the latter one of said two pulse signals is invalidated.

13. The method of detecting the weight of food placed on the turn table, according to claim 8, wherein a sound can be generated in any of a plurality of different sound patterns in said cooking apparatus, and the sound in said set sound pattern is generated when said type of said sound pattern to be generated is set.

* * * * *